United States Patent [19]

Vartanian

[11] 4,171,959

[45] Oct. 23, 1979

[54] FUEL COMPOSITION CONTAINING QUATERNARY AMMONIUM SALTS OF SUCCINIMIDES

[75] Inventor: Paul F. Vartanian, Wappingers Falls, N.Y.

[73] Assignee: Texaco Inc., White Plains, N.Y.

[21] Appl. No.: 860,545

[22] Filed: Dec. 14, 1977

[51] Int. Cl.[2] ..... C10L 1/22

[52] U.S. Cl. ..... 44/63; 44/71

[58] Field of Search ..... 44/63, 71; 252/34

[56] References Cited

U.S. PATENT DOCUMENTS

| | | | |
|---|---|---|---|
| 3,231,587 | 1/1966 | Rense | 252/34 |
| 3,962,104 | 6/1976 | Swietlik | 252/34 |

*Primary Examiner*—Winston A. Douglas
*Assistant Examiner*—Y. Harris-Smith
*Attorney, Agent, or Firm*—Thomas H. Whaley; Carl G. Ries; James J. O'Loughlin

[57] ABSTRACT

A motor fuel composition comprising a mixture of hydrocarbons boiling in the gasoline boiling range and a quaternary ammonium salt of a succinimide represented by the formula:

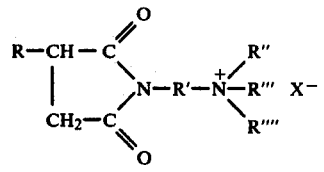

wherein R, R', R'', R''' and R'''' are hydrocarbon radicals and X is an anion.

13 Claims, No Drawings

FUEL COMPOSITION CONTAINING QUATERNARY AMMONIUM SALTS OF SUCCINIMIDES

BACKGROUND OF THE INVENTION

1. Field of the Invention

Modern internal combustion engine design is undergoing important changes to meet stricter standards concerning engine and exhaust gas emissions. One major change in engine design is the feeding of blow-by gases from the crankcase zone of the engine into the intake air-fuel mixture at the carburetor just below the throttle plate, rather than venting these gases to the atmosphere as in the past. The blow-by gases contain substantial amounts of deposit forming substances and are known to form deposits in and around the throttle plate area of the carburetor. Another significant change is the recirculation of a part of the exhaust gases to the fuel air intake of the engine. These exhaust gases also have deposit forming tendencies. The deposits caused by the recirculated gases both blow-by and exhaust gases restrict the flow of air through the carburetor at idle and at low speeds so that an overrich fuel mixture results. This condition produces rough engine idling and stalling and leads to the release of excessive hydrocarbon exhaust emissions to the atmosphere.

The noted design changes while effective for promoting a cleaner exhaust from the engine also lead a fouling of the carburetor and therefore dictate the need for an effective detergent fuel composition in order to maintain the cleanliness and efficiency of the carburetor.

2. Description of the Prior Art

U.S. Pat. No. 3,676,089 discloses a motor fuel composition containing an N-polyamine-substituted succinimide which promotes engine cleanliness particularly of the engine intake valves and ports.

SUMMARY OF THE INVENTION

The motor fuel composition of the invention comprises a mixture of hydrocarbons in the gasoline boiling range containing a minor amount of a quaternary ammonium salt of a succinimide represented by the formula:

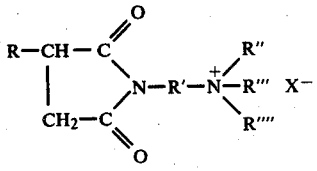

in which R, R', R'' and R'''' are hydrocarbon radicals and X is an anion. More specifically, R is a hydrocarbon radical having a molecular weight ranging from about 280 to 1800, R' is a divalent hydrocarbon radical having from 2 to 10 carbon atoms, R'' and R''' are hydrocarbon radicals having from 1 to 6 carbon atoms or are interconnected to form a heterocyclic ring consisting of from 3 to 6 atoms selected from the group consisting of carbon, nitrogen and oxygen atoms, R'''' is a hydrocarbon radical having from 1 to 6 carbon atoms, and X is the anion of an acid, i.e., a halide or an organic acid such as sulfonate or carboxylate.

SPECIFIC EMBODIMENTS OF THE INVENTION

The quaternary ammonium salt of a succinimide amine compound is prepared by reacting a succinimide amine compound having a residual amine function with a compound which will quaternize an amine. The resulting quaternary ammonium compound exhibits outstanding carburetor detergency when employed in a gasoline motor fuel composition and this property has been found to be in marked contrast to the effect of the succinimide precursor when employed in the same motor fuel composition.

The succinimide amine precursor which can be employed to prepare the quaternary ammonium salt or additive compound of the invention is represented by the following formula:

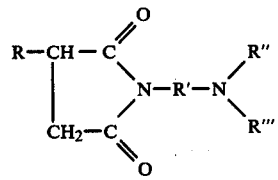

in which R is a hydrocarbon radical having a molecular weight ranging from about 280 to 1800, R' is a divalent hydrocarbon radical having from 2 to 10 carbon atoms and R'' and R''' are hydrocarbon radicals having from 1 to 6 carbon atoms or are interconnected to form a heterocyclic ring consisting of from 3 to 6 atoms selected from the group consisting of carbon, nitrogen and oxygen atoms.

The aliphatic hydrocarbon radical represented by R can be a saturated or unsaturated hydrocarbon radical. It will generally be an alkenyl or polyalkylene radical prepared by polymerizing an olefin, preferably a $C_3$ or $C_4$ olefin such as propylene or isobutylene, to form a polymer of the prescribed molecular weight. In the examples following, the molecular weight of this hydrocarbon radical is indicated in the brackets immediately following the name of the type of polymer employed. The molecular weight values are those as determined by Vapor Phase Osmometry.

The preferred hydrocarbon radicals are the polypropylene and polyisobutylene radicals prepared by polymerizing propylene and isobutylene respectively. A preferred molecular weight for this radical is a molecular weight ranging from 310 to 1400. A highly preferred lower molecular weight range for the hydrocarbon radical is the range from 325 to 425 while the preferred higher molecular weight range is from about 750 to 1300.

The divalent hydrocarbon radical represented by R' has from 2 to 6 carbon atoms. This can be a straight chain or cyclic divalent hydrocarbon radical. The preferred straight chain radicals have from 2 to 4 carbon atoms while those having 3 carbon atoms are particularly preferred.

R'' and R''' are hydrocarbon radicals having from 1 to 6 carbon atoms or R'' and R''' can be connected to form a heterocyclic ring consisting of from 3 to 6 atoms selected from the group consisting of carbon, nitrogen and oxygen atoms. When R'' and R''' are hydrocarbon radicals they are preferably alkyl radicals having from 1 to 2 carbon atoms, i.e., methyl and ethyl radicals. The preferred heterocyclic ring radicals are the morpholine, piperidine and piperazine. It is understood that the method for preparing alkenylsuccinic anhydride, is well known in the art and needs no detailed description here.

The foregoing succinimide amine is reacted with an organic reactant to form the quaternary salt of a succinimide additive of the invention. The organic reactant is represented by the formula:

$$R''''X$$

in which R'''' is the cation and is a hydrocarbon radical having from 1 to 6 carbon atoms and X is an anion selected from the group consisting of the halides, chloride, bromide, iodide and flouride and the residue of a carboxylate or sulfonate represented by the formulas $R^{\nu}COO$ and $R^{\nu}SO_3$ respectively wherein $R^{\nu}$ is a hydrocarbon radical having from 2 to 8 carbon atoms.

The prescribed succinimide amine and organic reactant are reacted by mixing them together in an inert hydrocarbon solvent, such as xylene, and heating the reaction mixture at an elevated temperature ranging from 60° to 100° C. or above for a sufficient length of time to effect the quaternization salt reaction. The extent of the reaction can be determined by comparing the total base number of the product with that of the precursor succinimide amine. After a sufficient reaction period, usually from 0.5 to 2 hours duration, the solvent and any unreacted organic acid are stripped from the reaction product under reduced pressure leaving the desired product.

Examples of quaternary ammonium salts of succinimides of the invention include polyisobutenyl (335)-N,N,N-trimethyl-propa-1,3-diamine succinimide quaternary ammonium iodide, polyisobutenyl (335)-N-methyl-N-(3-aminopropyl)morpholino succinimide quaternary ammonium iodide, polyisobutenyl (1200)-N,N,N-trimethylpropa-1,3-diamino succinimide quaternary ammonium iodide, polyisobutenyl (850)-N,N,N-trimethyletha-1,2-diamino succinimide quaternary ammonium iodide, polypropenyl (700)-N,N,N-triethylpropa-1,3-diamino succinimide quaternary ammonium bromide, polyisobutenyl (335)-N-methyl-N-(3-aminopropyl)piperazino succinimide quaternary ammonium iodide and polypropenyl (800)-N-methyl-N-(2-aminoethyl)piperazino succinimide quaternary ammonium chloride.

The following examples illustrate the method for preparing the additive of the invention.

EXAMPLE I

POLYISOBUTENYL (335)N,N,N-TRIMETHYLPROPA-1,3-DIAMINO SUCCINIMIDE QUATERNARY AMMONIUM IODIDE

To 110 g. of polyisobutenyl (335) N,N-dimethylpropa-1,3-diamino succinimide having a total base number (TBN) of 79.4 in 100 ml. of xylene solvent is added 35 g. (CA. 2:1 based on active succinimide concentration) of methyl iodide. The mixture was heated to 90° C. for one hour. The solvent and any unreacted methyl iodide was then stripped by reduced pressure distillation to give a substantial yield of the quaternized product having a total base number of 21.4.

EXAMPLE II

POLYISOBUTENYL (335)N-METHYL-N-(3-AMINOPROPYL)MORPHOLINO SUCCINIMIDE QUATERNARY AMMONIUM IODIDE

To 100 g. (0.17 mole) of polyisobutenyl (335)-N-(3-aminopropyl)morpholino succinimide having a total base number of 66.3 in 100 ml. of xylene solvent is added 25 g. (0.17 mole) of methyl iodide. The mixture was heated to 90° C. for one hour. The solvent and any unreacted methyl iodide was stripped off by distillation under reduced pressure to yield 105 g. of the quaternized product having a total base number of 13.8.

EXAMPLE III

POLYISOBUTENYL (1200)N,N,N-TRIMETHYLPROPA-1,3-DIAMINO SUCCINIMIDE QUATERNARY AMMONIUM IODIDE

To 110 g. of polyisobutenyl (1200 M.W.) N,N-dimethylpropa-1,3-diamino succinimide in 150 ml. of xylene solvent is added methyl iodide in approximately a 2:1 molar ratio of methyl iodide to the succinimide. The mixture is reacted as in Example I, the solvent and unreacted methyl iodide are removed by distillation and a substantial yield of polyisobutenyl (1200)N,N,N-trimethylpropa-1,3-diamino succinimide quaternary ammonium iodide is recovered.

EXAMPLE IV

POLYISOBUTENYL (850)-N,N,N-TRIMETHYLETHA-1,2-DIAMINO SUCCINIMIDE QUATERNARY AMMONIUM IODIDE

To 110 g. of polyisobutenyl (850 M.W.)-N,N-dimethyletha-1,2-diamino succinimide in 150 ml. of xylene is added methyl iodide in approximately a 2:1 molar ratio of methyl iodide to the succinimide. The mixture is reacted as in Example I above, the solvent and unreacted methyl iodide are removed and a substantial yield of polyisobutenyl (850)N,N,N-trimethyl etha-1,2-diamine succinimide quaternary ammonium iodide is recovered.

The corresponding quaternary ammonium halides, i.e., the chlorides, bromides and flourides are readily produced by replacing the methyl iodide with methyl chloride, methyl bromide or methyl flouride in the above examples.

Other quaternary ammonium salts are ammonium salts of organic acids particularly the ammonium sulfonates and ammonium carboxylates.

The base fuel which is useful for employing the additive of the invention is a motor fuel composition comprising a mixture of hydrocarbons boiling in the gasoline boiling range. This base fuel may consist of straight-chain or branched-chain paraffins, cycloparaffins, olefins, and aromatic hydrocarbons and any mixture of these. The base fuel can be derived from straight-chain naphtha, polymer gasoline, natural gasoline or from catalytically cracked or thermally cracked hydrocarbons and catalytically reformed stocks and boils in the range from about 80° to 450° F. The composition and the octane level of the base fuel are not critical. Any conventional motor fuel base may be employed in the practice of this invention.

In general, the additive of the invention is added to the base fuel in a minor amount, i.e., an amount effective to provide carburetor detergency to the fuel composition. The additive is highly effective in an amount ranging from about 0.003 to 0.25 weight percent based on the total fuel composition. An amount ranging from about 0.003 to 0.15 weight percent is preferred with the most preferred concentration ranging from about 0.005 to 0.10 weight percent.

The fuel composition of the invention may contain any of the additives normally employed in a motor fuel. For example, the base fuel may be blended with an anti-knock compound, such as a tetraalkyl lead compound, including tetraethyl lead, tetramethyl lead, tetrabutyl lead, cyclopentadienyl manganese tricarbonyl and chemical and physical mixtures thereof, generally in a concentration from about 0.05 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide. The motor fuel composition may also be fortified with any of the conventional anti-icing additives, corrosion inhibitors, dyes and the like.

Gasoline blends were prepared consisting of one of the above base fuels mixed with specified amounts of the prescribed fuel additives. The additive of the invention was tested for effectiveness in gasoline in the following performance tests:

The additive of the invention was tested for its effectiveness as a carburetor detergent in the Carburetor Detergency Test. This test is run on a Chevrolet V-8 engine mounted on a test stand using a modified four barrel carburetor. The two secondary barrels of the carburetor are sealed and the feed to each of the primary barrels arranged so that an additive fuel can be run in one barrel and the base fuel run in the other. The primary carburetor barrels were also modified so that they had removable aluminum inserts in the throttle plate area in order that deposits formed on the inserts in this area could be conveniently weighed.

In the procedure designed to determine the effectiveness of an additive fuel to remove preformed deposits in the carburetor, the engine is run as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blowby to the inlet in the carburetor body. The inserts are then removed from the carburetor and weighed to determine the difference between the performance of the additive and reference fuels in removing the preformed deposits. After the aluminum inserts are cleaned, they are replaced in the carburetor and the process repeated with the fuels reversed in the carburetor to minimize differences in fuel distribution and barrel construction. The deposit weights in the two runs are averaged and the effectiveness of the fuel composition of the invention is compared to the reference fuel which contains an effective detergent additive. The difference in effectiveness is expressed in percent, a positive difference indicating that the fuel composition of the invention was more effective that the commercial fuel composition.

The base fuel employed with the detergent additive of the invention in the following examples was a premium grade gasoline having a Research Octane Number of about 91 and contained 3.0 cc of tetraethyl lead per gallon. This gasoline consisted of about 30% aromatic hydrocarbons, 2.5% olefinic hydrocarbons and 67.5% paraffinic hydrocarbons and boiled in the range from 90° to 360° F.

The carburetor detergency test results obtained with the base fuel, comparison fuels and the fuel composition of the invention are set forth in the table below. The additive concentration in the comparison fuels, Runs 2 and 4, and in the fuel compositions of the invention, Runs 3 and 5, were at a concentration of 50 (PTB) pounds of additive per 1000 barrels of the fuel composition.

TABLE I

Chevrolet Carburetor Detergency Test, Phase III[a]

| Run | Additive (50 PTB | Buildup | Deposit moval | mg. Reness % | Effective- |
|---|---|---|---|---|---|
| 1. | Base Fuel (no carb. deter. add.) | | 16.8 | −1.7 | −10 |
| 2. | Polyisobutenyl (335)N,N-dimethyl-propa-1,3-diamine succinimide (I) | | 20.8 | −13.8 | −66 |
| 3. | Quaternary Ammonium Iodide Salt of Run 2 (Example I) | | 38.4 | 26.8 | +70 |
| 4. | Polyisobutenyl (335) N-(3-Aminopropyl)Morpholine Succinimide | | 17.1 | −15.9 | −93 |
| 5. | Quaternary Ammonium Iodide Salt of Run 4 (Example II) | | 27.0 | 17.6 | +65 |
| 6. | Premium Fuel Composition A[b] | | 36.7 | 13.3 | 36 |
| 7. | Premium Fuel Composition B[b] | | 21.8 | 17.1 | 78 |

[a]Clean-up type test

[b]Runs 6 and 7 were made employing premium commercial detergent fuel compositions.

The foregoing data shows that the detergent fuel composition of the invention, illustrated by Runs 3 and 5, exhibits a surprising improvement over comparison fuel compositions containing the precursor succinimide and over the base fuel. The performance of the fuel composition of the invention also is essentially equivalent to or substantially surpasses that of premium commercial detergent fuel compositions.

I claim:

1. A motor fuel composition comprising a mixture of hydrocarbons in the gasoline boiling range containing an effective detergent amount of a quaternary ammonium salt of a succinimide represented by the formula:

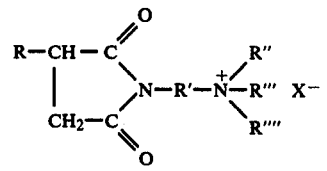

in which R is a hydrocarbon radical having a molecular weight ranging from about 280 to 1800, R′ is a divalent hydrocarbon radical having from 2 to 10 carbon atoms, R″ and R‴ are hydrocarbon radicals having from 1 to 6 carbon atoms or are interconnected to form a heterocyclic ring consisting of from 3 to 6 atoms selected from the group consisting of carbon, nitrogen and oxygen atoms, R⁗ is a hydrocarbon radical having from 1 to 6 carbon atoms, and X is the anion of an acid selected from the group consisting of halides, carboxylates and sulfonates.

2. A motor fuel composition according to claim 1 in which R has an average molecular weight ranging from about 310 to 1400.

3. A motor fuel composition according to claim 1 in which R is a polyisobutenyl radical having a molecular weight ranging from 325 to 425.

4. A motor fuel composition according to claim 1 in which R is a polypropenyl radical.

5. A motor fuel composition according to claim 1 in which said salt is polyisobutenyl (335)N,N,N-trimethylpropa-1,3-diamino succinimide quaternary ammonium halide.

6. A motor fuel composition according to claim 1 in which said salt is polyisobutenyl (335)-N-(3-aminopropyl)morpholino succinimide quaternary ammonium halide.

7. A motor fuel composition according to claim 1 in which said salt is polyisobutenyl (1200)N,N,N-trimethylpropa-1,3-diamino succinimide quaternary ammonium halide.

8. A motor fuel composition according to claim 1 in which said salt is polyisobutenyl (850)N,N,N-trimethylpropa-1,3-diamino succinimide quaternary ammonium halide.

9. A motor fuel composition according to claim 1 in which said salt is polypropenyl (850)N,N,N-trimethylpiperazino succinimide quaternary ammonium halide.

10. A motor fuel composition according to claim 1 in which said salt is the iodide.

11. A motor fuel composition according to claim 1 in which said salt is the bromide.

12. A motor fuel composition according to claim 1 containing from about 0.003 to 0.25 weight percent of said additive.

13. A motor fuel composition according to claim 1 containing from about 0.03 to 0.10 weight percent of said additive.

* * * * *